US011230771B2

(12) United States Patent
Tarabukin

(10) Patent No.: US 11,230,771 B2
(45) Date of Patent: Jan. 25, 2022

(54) HYDROGEN PRODUCTION IN THE PROCESS OF ELECTROCHEMICAL TREATMENT OF SULFUR-CONTAINING ACID GASES (HYDROGEN SULFIDE OR SULFUR DIOXIDE) SUPPLIED IN SOLUTION WITH AMINE-BASED OR OTHER ORGANIC ABSORBENTS

(71) Applicant: HYS ENERGY LTD, Bat-Yam (IL)

(72) Inventor: Gleb Nikolaevich Tarabukin, Bat-Yam (IL)

(73) Assignee: HYS ENERGY LTD, Bat-Yam (IL)

( * ) Notice: Subject to any disclaimer, the term of this patent is extended or adjusted under 35 U.S.C. 154(b) by 298 days.

(21) Appl. No.: 16/463,209

(22) PCT Filed: Nov. 23, 2017

(86) PCT No.: PCT/IL2017/051284

§ 371 (c)(1),
(2) Date: May 22, 2019

(87) PCT Pub. No.: WO2018/096540

PCT Pub. Date: May 31, 2018

(65) Prior Publication Data

US 2019/0376189 A1 Dec. 12, 2019

Related U.S. Application Data

(60) Provisional application No. 62/425,628, filed on Nov. 23, 2016, provisional application No. 62/425,633, filed on Nov. 23, 2016.

(51) Int. Cl.
*C25B 1/02* (2006.01)
*C25B 13/04* (2021.01)
(Continued)

(52) U.S. Cl.
CPC ..... *C25B 1/02* (2013.01); *C25B 9/19* (2021.01); *C25B 9/70* (2021.01); *C25B 13/04* (2013.01); *C25B 15/02* (2013.01); *C25B 15/08* (2013.01)

(58) Field of Classification Search
CPC .... C25B 1/00; C25B 1/01; C25B 1/02; C25B 1/04
See application file for complete search history.

(56) References Cited

U.S. PATENT DOCUMENTS 3,409,520 A 11/1968 Bolmer
3,888,750 A 6/1975 Brecher et al.
(Continued)

FOREIGN PATENT DOCUMENTS

JP 2008/223098 A 9/2008
WO 2004/114430 A2 12/2004
(Continued)

OTHER PUBLICATIONS

Hydrogen Sulfide (https://www.sciencedirect.com/topics/engineering/hydrogen-sulfide#:~:text=The%20solubility%20of%20hydrogen%20sulfide,ml%20at%20100%C2%B0C.) (Year: 2016).*
(Continued)

*Primary Examiner* — Nicholas A Smith
(74) *Attorney, Agent, or Firm* — Paul D. Bianco; Gary S. Winer; Fleit Intellectual Property Law

(57) ABSTRACT

A method and an electrochemical cell for hydrogen production by electrochemical decomposition of a sulfur-containing acid gas such as $H_2S$ or $SO_2$ are disclosed. The method comprises electrolysis of the acid gas in solution in the presence of an absorbent, which may be chemical, physical, or a mixture thereof. In typical embodiments, the absorbent is alkanolamine-based.

20 Claims, 2 Drawing Sheets

(51) Int. Cl.

| | |
|---|---|
| ***C25B 15/02*** | (2021.01) |
| ***C25B 15/08*** | (2006.01) |
| ***C25B 9/19*** | (2021.01) |
| ***C25B 9/70*** | (2021.01) |

(56) References Cited

U.S. PATENT DOCUMENTS

| | | | | |
|---|---|---|---|---|
| 4,306,950 | A | 12/1981 | Lu | |
| 4,412,895 | A | 11/1983 | Lu | |
| 4,436,714 | A | 3/1984 | Olson | |
| 4,443,424 | A | 4/1984 | Olson | |
| 4,460,444 | A | 7/1984 | Maskalick | |
| 4,859,292 | A * | 8/1989 | Appleby | H01M 8/0656 205/354 |
| 4,995,952 | A | 2/1991 | Dandapani et al. | |
| 5,908,545 | A | 6/1999 | Donini et al. | |
| 7,261,874 | B2 | 8/2007 | Lahoda et al. | |
| 7,378,068 | B2 | 5/2008 | Mao et al. | |
| 8,956,526 | B2 | 2/2015 | Gorensek | |
| 2009/0045073 | A1 | 2/2009 | Stone et al. | |
| 2011/0180417 | A1* | 7/2011 | Steimke | C25B 15/02 205/337 |
| 2014/0093440 | A1 | 4/2014 | McGarvey et al. | |
| 2014/0197040 | A1* | 7/2014 | Gordon | C25C 1/02 205/702 |

FOREIGN PATENT DOCUMENTS

| | | | |
|---|---|---|---|
| WO | 2009/026640 | A1 | 3/2009 |
| WO | 2013/191402 | A1 | 12/2013 |
| WO | 2014/178744 | A1 | 11/2014 |

OTHER PUBLICATIONS

International Preliminary Report on Patentability dated May 28, 2019 with Written Opinion for PCT/IL2017/051284 filed Nov. 23, 2017 (English translation).

International Search Report dated Jan. 14, 2018 for PCT/IL2017/051284 filed Nov. 23, 2017.

Written Opinion for PCT/IL2017/051284 filed Nov. 23, 2017.

* cited by examiner

HYDROGEN PRODUCTION IN THE PROCESS OF ELECTROCHEMICAL TREATMENT OF SULFUR-CONTAINING ACID GASES (HYDROGEN SULFIDE OR SULFUR DIOXIDE) SUPPLIED IN SOLUTION WITH AMINE-BASED OR OTHER ORGANIC ABSORBENTS

REFERENCE TO RELATED PUBLICATIONS

This application claims the benefit of U.S. Provisional Pat. Appl. Nos. 62/425,628 and 62/425,633, both of which were filed 23 Nov. 2016.

FIELD OF THE INVENTION

The invention relates in general to means and methods for production of hydrogen in the electrochemical treatment of sulfur-containing acid gases. It relates in particular to electrochemical methods for producing hydrogen in an electrochemical cell that contains a feed/electrolyte solution of a sulfur-containing acid gas and an appropriate absorbent.

BACKGROUND

The problem of hydrogen sulfide and sulfur dioxide gases represents a significant industrial concern. Due to their adverse effects on industrial processes, human health and the environment, it is necessary to remove these acid gases from all effluent streams. There are a number of industrial processes for sulfur recovery and flue gas desulfurization, but they are CAPEX and OPEX intensive. The necessity to remove hydrogen sulfide and sulfur dioxide to ever-lower levels (due to a climate change concern and strengthening environmental regulations) and the growing hydrocarbon worldwide production—provide a great opportunity for the development of new technologies of gas purification.

Chemical and physical absorption is one of the main processes of hydrocarbon gases purification from acid components. The most commonly used hydrogen sulfide absorbents are aqueous solutions based on alkanolamines, physical hydrogen sulfide solvents and mixed absorbers based on alkanolamines and physical hydrogen sulfide solvents. In conventional methods, the hydrogen sulfide-rich absorbents are regenerated by heating/stripping at reduced pressure and the acid gas then passes to the sulfur recovery plant.

Currently, the main ways of processing hydrogen sulfide after the process of hydrocarbon gas purification are to produce elemental sulfur via the Claus process or sulfuric acid via wet sulfuric acid process (WSA process). Such $H_2S$ processing units require high capital investments, and as the final products (sulfur or sulfuric acid) are of low commercial value, there is a high demand to find more economical and efficient hydrogen sulfide utilization methods.

At the same time, it has long been realized that electrochemical treatment of hydrogen sulfide can lead to the production of high-purity hydrogen gas and elemental sulfur. The removal of $H_2S$ electrochemically has many economic and environmental benefits. The value of the hydrogen makes the system more profitable.

The small Gibbs energy possessed by $H_2S$ enables it to cleanly split into elemental sulfur and diatomic hydrogen with a low energy and voltage requirement. The energy benefit of electrolytic splitting of the $H_2S$ in comparison with the electrolysis of water is illustrated in eqs (1) and (2) (see, for example, Jonathan Chinwendu Mbah, "Endurance materials for hydrogen sulfide splitting in electrolytic cell", University of South Florida, 2008):

$$H_2S\ (g) \rightarrow S\ (l) + H_2\ (g) - 2\ \text{Faradays}\ @0.26V\ \Delta G^o = 8.9\ \text{kcal/mole}\ @400\ K \quad (1)$$

$$H_2O \rightarrow H_2 + 1/2O_2 - 2\ \text{Faradays}\ @1.2V\ \Delta G^o = 57\ \text{kcal/mole} \quad (2)$$

Hydrogen sulfide is slightly soluble in water and acts as a weak acid. As a weak acid, it dissociates in aqueous solution into a hydrogen cation (H) and a hydrosulfide anion (HS) according to eq (3):

$$H_2S \rightarrow HS^- + H^+ \quad (3)$$

The proton ($H^+$) is strongly bound to water forming the basic hydronium ion ($H_3O^+$). Hydrogen sulfide has a considerably larger dissociation constant than that of water, eqs (4) and (5):

$$H_2S\ (aq) + H_2O\ (l) \rightarrow H_3O^+(aq) + HS^-(aq)\ Ka = 1\times10^{-7} \quad (4)$$

$$H_2O\ (l) + H_2O\ (l) \rightarrow H_3O^+(aq) + OH^-(aq)\ Ka = 1\times10^{-14} \quad (5)$$

The presence of all these intermediary ions is sufficient to conduct the flow of electrical current through the solution.

The chemical bond dissociation energy of H—O is 102.3 kcal/mol at 298 K. In $H_2S$, the bond dissociation energy of H—S bond is only 82.3 kcal/mol at 298 K; see "Bond Dissociation Energies in Simple Molecules" National Standard Reference Data System, National Bureau of Standards, No. 31, Washington, D.C., 1970. The basic thermodynamically reversible potential for electrolysis of an aqueous solution saturated with $H_2S$ should be less than that of water. The minimum possible cell voltage (reversible voltage) for conventional water electrolysis is 1.23 volts at 25° C. However, commercial electrolyzers typically require higher voltages ranging from 1.8 V to 2.6 V (Kirk-Othmer, 1991, Encyclopedia of Chemical Technology, Fourth Edition). For the overall electrolysis reaction of an aqueous solution saturated with $H_2S$ the standard (theoretical) potential is 0.171 V compared to 1.23 V for the electrolysis of water.

A process for electrolysis of water using hydrogen sulfide is disclosed in U.S. Pat. No. 4,995,952. The process comprises electrolyzing hydrogen sulfide in an aqueous alkaline solution substantially free of organic solvents. In this process, substantially pure hydrogen gas is generated continuously at the cathode and sulfur is generated continuously at the anode. The energy needed to break the H—S bond and produce hydrogen is not high enough to produce oxygen at the anode, and thus avoids any separation in the electrolytic processes.

A method of using hydrogen sulfide as a reducing agent in an electrochemical cell is disclosed in PCT Pat. Appl. Pub. No. WO2004/114430. The method comprises feeding a feed/electrolyte mixture containing $H_2S$, sea salt, and water, to an electrochemical cell comprising a housing with porous membranes, which accommodates a gas diffusion positive electrode with hydrophobized barrier layer, and a carbon negative electrode provided with a catalyst. In operation of the electrochemical cell, oxygen reduction occurs at the positive electrode, and hydrogen sulfide is oxidized to form various anions at the negative electrode. A cell of this design provides a voltage of 0.388 V and a discharge current of 15 $mA/cm^2$, and has an efficiency of about 77%.

U.S. Pat. No. 7,378,068 discloses a process for the removal of hydrogen sulfide from hydrogen sulfide gas containing gaseous streams with a sodium hydroxide solution, followed by oxidation of sulfide ions to sulfur in an electrochemical cell; in this method the sodium hydroxide solution is used as an electrolyte.

Methods for removing hydrogen sulfide from gases using polyvalent metal chelate complexes and regeneration of the solution in an electrochemical cell with recovery of sulfur have been disclosed; see, for example, U.S. Pat. Nos. 4,443,424 and 4,436,714. In these methods, the regeneration of the polyvalent metal chelate complex absorption solution is combined with generation of electric power.

An electrochemical process for decomposing $H_2S$ to produce $H_2$ and S is disclosed in U.S. Pat. No. 5,908,545. The process comprises mixing hydrogen sulfide with a volatile basic solution containing about 20-80% ammonia, electrolyzing said mixed solution in an electrolytic cell to form hydrogen at the cathode and a solution containing polysulfides at the anode, separating and distilling the polysulfide-containing solution to boil off said volatile basic solution and recover molten sulfur and recycling the boiled off volatile basic solution to be mixed with further hydrogen sulfide.

A disadvantage of these methods above is that absorbents used in these processes are not widespread in the oil and gas industry and the implementation of such technologies at existing facilities will be capital intensive.

A method of purifying hydrogen sulfide-containing gas using an electrochemical process is disclosed in PCT Pat. Appl. Pub. No. WO2014/178744. The method comprises combining hydrogen sulfide gas purification by absorbents with the generation of electricity in a fuel cell, in which hydrogen sulfide is used as fuel for the fuel cell. The main advantage of the method is that it uses absorbents widespread in the oil and gas industry such as alkanolamine-based absorbents and/or physical hydrogen sulfide absorbents. The method provides direct continuous process of electricity generation in a fuel cell using aqueous absorbent solution saturated with hydrogen sulfide as a fuel source. The method has the disadvantage that it does not include purposeful production of hydrogen as a product, so therefore, any electrical energy generated by the process must be consumed in situ or be sold to the grid. The hydrogen as a product is consumed in different hydrotreating processes in refineries (such as hydrodesulfurization, hydroisomerization, dearomatization, hydrocracking) and is often used as an energy storage medium but these main advantages of hydrogen could not be used in the above process.

Major industrial sources of atmospheric sulfur dioxide ($SO_2$), which is recognized as a major atmospheric pollutant, include flue gas emitted by burning of sulfur-containing fossil fuels in power plants, incinerators, and boilers; roasting of sulfide ore in metallurgy and the sulfuric acid industry; and tail gas incineration in sulfur recovery plants used in the oil and gas industries. The adverse effects of $SO_2$ on human health and the environment make necessary its abatement in flue gases, e.g. by the use of flue gas desulfurization (FGD) processes.

Many FGD processes are known in the art. For example, processes have been developed in which absorbents such as limestone, calcium hydroxide and magnesium hydroxide slurries, sodium hydroxide solutions, are used. The most well-known flue gas desulfurization processes are mainly based on scrubbing with limestone slurries. These are non-regenerative processes, as the used absorbent is not regenerated, but rather is generally either discarded in a landfill or converted into gypsum for use in wallboard and cement manufacturing. Disposal in a landfill requires a large initial capital investment as well as significant resources to maintain the landfill throughout the life of the plant.

FGD methods that use organic solvents as $SO_2$-removal agents have been explored because the absorbing agents can be regenerated repeatedly. Solvent regeneration (stripping) is usually accomplished by flashing at lower pressure than absorption with moderate heat input. There are chemical and physical regenerative organic solvents. Physical-chemical absorption process aims to combine the high absorption potential of chemical absorption and the low regeneration energy requirement of the physical solvent (physical absorption).

Sulfur dioxide gas is readily soluble in water. In aqueous solution, dissolved $SO_2$ undergoes reversible hydration and ionization according to eqs (6) and (7):

$$SO_{2(g)} \leftrightarrow SO_{2\,(aq)} \tag{6}$$

$$SO_{2\,(aq)} + H_2O_{\,(L)} \leftrightarrow HSO_3^- + H^+ \tag{7}$$

As $SO_2$ is an acidic gas, increasing the pH of the absorbent solution is favorable to the absorption. For example, the quantity of $SO_2$ dissolved can be increased by adding an amine to the water. The reactions of $SO_2$ in solution are instantaneous. According to eqs (8)-(10), the buffer drives the above equilibria to the right by reacting with the hydrogen ions ($H^+$) to form ammonium salts.

$$\text{Amine} + H^+ \leftrightarrow [\text{Amine}]H^+ \tag{8}$$

$$\text{Amine} + SO_2 + H_2O \leftrightarrow [\text{Amine}]H^+ + HSO_3^- \tag{9}$$

$$\text{Amine} + HSO_3^- \leftrightarrow [\text{Amine}]H^+ + SO_3^{2-} \tag{10}$$

As the concentration of $SO_2$ in the feed gas increases, the equilibrium moves to the right, i.e. the quantity of $SO_2$ dissolved in the rich solvent increases. Thus, the scrubbing of more concentrated gas streams requires a less than proportional increase in solvent circulation rate. Since the gas volume, and therefore the gas side equipment, remains constant, a relatively small total cost increase is caused by an increase in feed $SO_2$ concentration ("A Novel Selective Flue Gas $SO_2$ Removal with an Amine Absorbent", H. Mehrara et al, Abadan Institute of Technology Petroleum University of Technology, 2013; International Journal of Advanced Research Foundation, p. 11-17, Volume 2, Issue 6, June 2015).

Eqs (11) and (12) present a model, proposed by Caplow in 1968 and extended by Danckwerts in 1979, for an amphoteric ion mechanism for reaction of $SO_2$ in an amine ($RNH_2$), where B represents amine molecules and hydroxyl ions in solution:

$$SO_2 + RNH_2 \leftrightarrow RNH_2^+SOO^- \tag{11}$$

$$RNH_2^+SOO^- + RNHSOO^- + BH^+ \tag{12}$$

The $SO_2$ generated by $RNHCOO^-$ degrades when heated during the regeneration process. The regeneration reaction mechanism is given in eqs (13)-(15):

$$RNHSOO^- + H_2O \leftrightarrow SO_2 + RNH_2 + OH^- \tag{13}$$

$$HSO_3^- \leftrightarrow SO_2 + OH^- \tag{14}$$

$$SO_3^{2-} + H_2O \leftrightarrow SO_2 + 2OH^- \tag{15}$$

In the regeneration process, the bisulfite anions are converted to sulfite anions and are flushed from the solvent as sulfur dioxide gas.

Sulfur dioxide recovered from the flue gas can be used as final product or further processed to elemental sulfur by recycling back to the Sulfur recovery Claus unit or to the sulfuric acid at sulfuric acid unit. As final product sulfur dioxide can be used in bleaching as a feed chemical, hydrosulfite manufacture, for pH adjustment and residual peroxide destruction, but possible involuntary global production of pure $SO_2$ after flue gas desulfurization (FGD) processes substantially exceeds the total consumption. In many cases, the further processing of $SO_2$ to elemental sulfur or to sulfuric acid is not feasible, that is why there is a high demand to find economical and efficient methods for sulfur dioxide utilization after its recovery by the absorbing agents from the flue gas.

It has long been realized that sulfur dioxide can serve as an anode depolarizer in water electrolysis process for hydrogen production. Sulfur dioxide depolarized water electrolysis (SDE) produces sulfuric acid and hydrogen. Due to its lower cell voltage, the process requires far less electricity than traditional water electrolysis.

Development of sulfur dioxide depolarized water electrolysis methods began about 50 years ago as part of an effort to find and economically efficient way to produce hydrogen. The Hybrid Sulfur Cycle (HyS) or Westinghouse process (also known as Ispra Mark 11) was patented in 1975 by Brecher and Wu (U.S. Pat. No. 3,888,750). It is a two-step process, comprising a low-temperature electrochemical step and a high temperature, thermochemical step. In the electrochemical step of the HyS cycle, sulfuric acid and hydrogen are produced by sulfur dioxide depolarized electrolysis (SDE). In the thermochemical part, the sulfuric acid formed in electrolysis is concentrated and decomposed thermally to $SO_2$ and $O_2$. The $SO_2$ is recirculated back to the electrolysis step for hydrogen generation.

In the Westinghouse process, separate liquid streams feed the electrolyzer and are referred to as the catholyte and the anolyte. The catholyte is an aqueous solution of sulfuric acid and the anolyte is an aqueous solution of sulfuric acid and dissolved $SO_2$. Sulfur dioxide is oxidized at the anode to produce sulfuric acid and protons (actually hydronium ions). Thus, the outlet anolyte stream has a higher concentration of sulfuric acid than the inlet anolyte stream. The protons produced at the anode are transported as hydronium ions across the cation-exchange membrane into the catholyte and are reduced at the cathode to produce hydrogen gas.

The solubility of $SO_2$ is lower in dilute sulfuric acid than it is in pure water (Hayduk, Asatani and Lu 1988; Govindarao and Gopalakrishna 1993). When the concentration of sulfuric acid is increased, the solubility behavior of $SO_2$ can be described as physical solubility, while in less acidic (or alkaline) solutions the solubility is enhanced by the "chemical solubility" caused by hydrolysis reactions or chemical reactions with other possible species present in the solution (Maurer 2011; Zhang et al. 1998).

For a short- to medium-term application, the new "Outotec open cycle" process (OOC) is an attractive alternative for hydrogen production, as it involves only one stage (SDE) and does not require sulfuric acid decomposition. The $SO_2$ used in the process can be obtained from flash smelting, sulfides roasting, sulfur combustion or any other similar operation, and because sulfuric acid is commercial product, the cycle is left open. Roughly, one third of the world's annual sulfuric acid is a by-product of metallurgical operations, while 60% of the sulfuric acid produced originates from the burning of elemental sulfur or from the roasting of pyrite carried out to produce feedstock for sulfuric acid manufacture. With the OOC process, hydrogen production could be coupled with metallurgical or other operations. With a worldwide production of sulfuric acid of 200-250 Mta, the by-product hydrogen opportunity with this process is 4-5 Mta (Lokkiluoto, 2013). The "Outotec open cycle" process is described in U.S. Pat. No. 7,794,685.

In conventional water electrolysis, water is dissociated yielding hydrogen gas at the cathode and oxygen gas at the anode. The electrochemical decomposition energy of water is relatively high since water molecules have a stable structure at ambient temperature. The following reactions occur in standard water electrolysis:

$$\text{at anode: } 2H_2O \rightarrow 4H^+ + 4\bar{e} + O_2 \quad (16)$$

$$\text{at cathode: } 4H^+ + 4\bar{e} \rightarrow 2H_2 \quad (17)$$

$$\text{Overall reaction: } 2H_2O \rightarrow 2H_2 + O_2 \quad E_0 = +1.23\ V \quad (18)$$

In the SDE electrolyzer, hydrogen gas is still produced at the cathode, but at the anode, $SO_2$ is oxidized to $SO_3$, which combines with water to form sulfuric acid:

$$\text{At anode: } SO_{2\,(aq)} + 2H_2O \rightarrow 4H^+ + 2\bar{e} + SO_4^{2-}{}_{(aq)} \quad (19)$$

$$\text{At cathode: } 2H^+ + 2\bar{e} \rightarrow H_{2(g)} \quad (20)$$

$$\text{Overall reaction: } SO_{2\,(aq)} + 2H_2O \rightarrow H_2SO_{4\,(aq)} + H_{2(g)} \quad E_0 = +0.158\ V \quad (21)$$

The advantage of the SDE process is that $SO_2$ oxidation occurs at a much lower voltage than water electrolysis. The standard reversible voltage $E_0$ of the net cell reaction is only 0.158 V (Gorensek, Staser, Stanford and Weidner 2009), versus the $E_0$=1.23 V needed in conventional water electrolysis. Practical SDE cell voltages are 0.45 to 0.60 V versus 1.8 V to 2.6 V in conventional water electrolysis.

Different aspects of SDE electrolyzer design and electrolysis process have been described in U.S. Pat Nos. 4,306,950, 4,412,895, 4,460,444, and 7,261,874, and U.S. Pat. Appl. Pub. No. 2007/0007147 to Westinghouse Electric Corp., as well as in patents and patent applications to others such as Japanese Pat. No. 2008-223098, PCT. Pat. Appl. Nos. WO/2013191402 and WO/2009026640, and U.S. Pat. Appl. No. 2009/0045073. The Hybrid Sulfur Cycle (HyS) and SDE electrolyzer design is disclosed in U.S. Pat. No. 8,956,526.

The main disadvantage of the methods and SDE electrolyzer designs disclosed in the above mentioned patents is major design challenges due to corrosive feed/electrolyte solution used in the electrochemical cell (including sulfur dioxide in water solution or $SO_2$-saturated sulfuric acid). Concentrated sulfuric acid is a very weak acid and a poor electrolyte but in the dilute state, it is a strong acid, which will corrode most materials. The formation of sulfuric acid during electrolysis leads to material selection problems that need to be overcome to make the process economical and efficient.

Thus, a process for desulfurization of gases containing sulfur-containing acid gases such as $H_2S$ and $SO_2$, in which the process produces $H_2$ gas, that are energy- and cost-efficient, and that overcome the material selection problems of methods known in the art, remains a long-felt but as yet unmet need.

BRIEF SUMMARY OF THE INVENTION

The invention disclosed herein is designed to meet this need. A method and apparatus for electrochemical production of hydrogen combined with purification of gases containing acidic sulfur-containing contaminants is disclosed. The invention discloses an electrochemical method in which a feed/electrolyte solution comprising a sulfur-containing acid gas and an absorbent is introduced into an electrochemical cell, in which hydrogen is electrochemically produced (e.g. by reduction of $H_2S$ or water) and the sulfur is oxidized (e.g. to elemental sulfur or $H_xSO_y^{n-}$).

Implementing the present invention provides co-production of hydrogen. The resulting hydrogen can then be used as a reagent, e.g. in hydrotreating processes in refineries and in other industries, thus providing an additional benefit to the present invention over methods known in the art. The value of the hydrogen makes the flue gas purification system described herein more economically effective.

It is therefore an object of the present invention to disclose a method for production of hydrogen gas from a sulfur-containing acid gas, wherein said method comprises:

providing at least one electrochemical cell, said electrochemical cell comprising at least one positive electrode (anode) and one negative electrode (cathode); solution supply and withdrawal means for supplying and withdrawing a feed/electrolyte solution to and from said electrochemical cell; product withdrawal means for withdrawing from said electrochemical cell products of electrochemical reactions occurring within said electrochemical cell; and, electrical connecting means configured to provide external electrical connections to at least one of said positive electrode and said negative electrode;

supplying to said electrochemical cell a feed/electrolyte solution comprising a sulfur-containing acid gas and at least one absorbent for said sulfur-containing acid gas;

connecting said electrochemical cell to an external power supply so as to cause within said electrochemical cell an electrochemical reaction that produces hydrogen gas; and, removing said electrochemically produced hydrogen gas from said electrochemical cell.

It is a further object of this invention to disclose such a method, wherein said electrochemical cell comprises a proton-conductive separator that divides said cell into an anode compartment in electrical connection with said anode and a cathode compartment in electrical connection with said cathode; and said solution supply and withdrawal means are in fluid connection with said anode compartment but are not in fluid connection with said cathode compartment. In some preferred embodiments, said proton-conductive separator comprises at least one proton-conductive membrane. In some preferred embodiments of the invention, said proton-conductive separator comprises at least one catalyst layer. In some preferred embodiments of the invention in which the proton-conductive separator comprises at least one catalyst layer, said catalyst layer comprises an anode side and a cathode side; said anode side comprises a catalyst selected from the group consisting of platinum, ruthenium, palladium, and mixtures thereof, and said cathode side comprises a catalyst selected from the group consisting of platinum, ruthenium, palladium, iridium, aluminum, lead, metal oxides, mixtures thereof, alloys thereof, and combinations thereof.

It is a further object of this invention to disclose the method as defined in any of the above, wherein said electrochemical cell comprises circulating means configured to circulate feed/electrolyte solution through said electrochemical cell.

It is a further object of this invention to disclose the method as defined in any of the above, wherein said feed/electrolyte solution comprises hydrogen sulfide and an absorbent selected from the group consisting of alkanolamines, physical hydrogen sulfide absorbents, and mixtures thereof; and said method comprises removing from said electrochemical cell sulfur produced in said electrochemical reaction. In some preferred embodiments of the invention, said feed/electrolyte solution comprises at least 10% by weight of said absorbent.

In some preferred embodiments of the invention in which said feed/electrolyte solution comprises hydrogen sulfide, said alkanolamine is selected from the group consisting of monoethanolamine, diethanolamine, triethanolamine, methyldiethanolamine, diisopropanolamine, diglycolamine, and mixtures thereof. In some preferred embodiments of the invention said feed/electrolyte solution comprises hydrogen sulfide, said physical hydrogen sulfide absorbent is selected from the group consisting of N-methylpyrrolidone, dimethyl ether of polyethylene glycol, tributyl phosphate, and methanol.

It is a further object of this invention to disclose the method as defined in any of the above, wherein said feed/electrolyte solution comprises water, sulfur dioxide, and an absorbent selected from the group consisting of amine compounds, chemical sulfur dioxide absorbents, physical sulfur dioxide absorbents, and mixtures thereof, and said method comprises removing from said electrochemical cell said feed/electrolyte solution containing products of said electrochemical reaction. In some preferred embodiments of the invention, said feed/electrolyte solution comprises at least 10% by weight of said absorbent.

In some preferred embodiments of the invention in which said feed/electrolyte solution comprises water, sulfur dioxide, and an absorbent selected from the group consisting of amine compounds, chemical sulfur dioxide absorbents, physical sulfur dioxide absorbents, and mixtures thereof, said amine compound is selected from the group consisting of primary amines, secondary amines, tertiary amines, triamines, and tetraamines. In some preferred embodiments, said amine compound is selected from the group consisting of Monoethanolamine (MEA), Diethanolamine (DEA), Trimethylamine (TMA), Triethylamine (TEA), Triethanolamine (TEOA), Methyldiethanolamine (MDEA), Dimethylamine (DMA), Diisopropanolamine (DIPA), Diglycolamine (DGA), Tripropanolamine, Tributanolamine, Tetrahydroxy-methylenediamine, Tetrahydroxyethyl-ethylenediamine, Tetrahydroxyethyl-1,3-propylenediamine, Tetrahydroxyethyl-1,2 propylenediamine, Tetrahydroxyethyl-1,5-pentylenediamine, Dihydroxyethyl-ethylenediamine, Monohydroxymethyl-diethylenetriamine, Monomethyl-monohydroxylethyl-triethylenetetramine, Diethylenetriamine, Triethylenetetramine, Tetraethylenepentamine, N,N,N,N'-Tetrakis-(2-hydroxyethyl)-1,3-diaminopropane, N,N,N',N'-Tetrakis-(2-hydroxyethyl)-ethylenediamine, N,N,N',N'-Tetrakis (Z-hydroxyethyl)-ethylenediamine, N,N,N',N'-Tetramethyl-ethylenediamine, N,N,N',N'-Tetramethyl-diaminomethane, N,N',N'-Trimethyl-N-(2-hydroxyethyl)-ethylenediamine, N',N'-Dimethyl-N,N-bis(2-hydroxyethyl)-ethylenediamine, N,N'-Dimethylpiperazine, N,N'-Bis(2-hydroxyethyl)-piperazine, N-Methyl, N'-(2-hydroxyethyl)-piperazine, N-(2-hydroxyethyl)-ethylenediamine, N-(2-hydroxyethyl)-piperazine, N-Methyl-piperazine, and mixtures thereof. In some especially preferred embodiments, said feed/electrolyte solution comprises at least one organic solvent selected from the group consisting of pyridine and piperazine.

In some preferred embodiments of the invention in which said feed/electrolyte solution comprises water, sulfur dioxide, and an absorbent selected from the group consisting of amine compounds, chemical sulfur dioxide absorbents, physical sulfur dioxide absorbents, and mixtures thereof, said physical sulfur dioxide absorbent is selected from the group consisting of Dimethyl ether (DME), Polyethylene glycol, Tributyl phosphate, Methanol, Dimethyl Ether of Polyethylene Glycol (DEPG), Diethylene Glycol Methyl Ether (DGM), Sulfolane (SUF), Ethylene glycol (EG), Propylene carbonate (PC), N-methylimidazole (NMI), N-Methyl-Pyrrolidone (NMP), and mixtures thereof.

It is a further object of this invention to disclose the method as defined in any of the above, wherein said method comprises regenerating said absorbent from products of said electrochemical reactions. In some preferred embodiments, said step of regenerating said absorbent comprises separating said absorbent from said feed/electrolyte solution.

It is a further object of this invention to disclose the method as defined in any of the above, wherein said step of supplying to said electrochemical cell a feed/electrolyte solution comprising a sulfur-containing acid gas and at least one absorbent for said sulfur-containing acid gas comprises supplying a feed/electrolyte solution comprising a sulfur-containing acid gas obtained from a sour gas. In some preferred embodiments of the invention, the method comprises passing a stream of said sour gas through a column containing an absorbent such that said sulfur-containing acid gas is removed from said sour gas stream by reaction with said absorbent to form said feed/electrolyte solution. In some preferred embodiments of the invention, said sour gas is selected from the group consisting of flue gas and natural gas (methane) comprising sulfur-containing acid gas impurities.

It is a further object of this invention to disclose the method as defined in any of the above, wherein said step of providing at least one electrochemical cell comprises providing a plurality of electrochemical cells connected in series.

It is a further object of this invention to disclose an electrochemical cell (electrolyzer) for production of hydrogen in the presence of a sulfur-containing acid gas, wherein said cell comprises: at least one positive electrode (anode) and one negative electrode (cathode); solution supply and withdrawal means for supplying and withdrawing a feed/electrolyte solution comprising said sulfur-containing acid gas to and from said electrochemical cell; product withdrawal means for withdrawing from said electrochemical cell products of electrochemical reactions occurring within said electrochemical cell; and, electrical connecting means configured to provide external electrical connections to at least one of said positive electrode and said negative electrode.

It is a further object of this invention to disclose such an electrochemical cell, wherein said electrochemical cell comprises a proton-conductive separator that divides said cell into an anode compartment in electrical connection with said anode and a cathode compartment in electrical connection with said cathode; and said solution supply and withdrawal means are in fluid connection with said anode compartment but are not in fluid connection with said cathode compartment. In some preferred embodiments, said proton-conductive separator comprises at least one proton-conductive membrane. In some preferred embodiments, said proton-conductive separator comprises at least one catalyst layer. In some preferred embodiments, said catalyst layer comprises an anode side and a cathode side; said anode side comprises a catalyst selected from the group consisting of platinum, ruthenium, palladium, and mixtures thereof; and said cathode side comprises a catalyst selected from the group consisting of platinum, ruthenium, palladium, iridium, aluminum, lead, metal oxides, mixtures thereof, alloys thereof, and combinations thereof.

It is a further object of this invention to disclose an electrochemical cell as defined in any of the above, wherein said electrochemical cell comprises circulating means configured to circulate feed/electrolyte solution through said electrochemical cell.

It is a further object of this invention to disclose an electrochemical cell as defined in any of the above, comprising a feed/electrolyte solution comprising said sulfur-containing acid gas and an absorbent for said sulfur-containing acid gas. In some preferred embodiments, at least one of solution supply and withdrawal means and said product withdrawal means is in fluid connection with regenerating means for regenerating said absorbent from products of said electrochemical reactions.

It is a further object of this invention to disclose an electrochemical cell as defined in any of the above, wherein said sulfur-containing acid gas is hydrogen sulfide; said absorbent is selected from the group consisting of alkanolamines, physical hydrogen sulfide absorbents, and mixtures thereof; and said product withdrawal means comprise means for withdrawing sulfur from said electrochemical cell.

It is a further object of this invention to disclose an electrochemical cell as defined in any of the above, wherein said sulfur-containing acid gas is sulfur dioxide; said absorbent is selected from the group consisting of amine compounds, chemical sulfur dioxide absorbents, physical sulfur dioxide absorbents, and mixtures thereof; and said product withdrawal means comprise means for withdrawing said feed/electrolyte solution containing products of said electrochemical reaction.

It is a further object of this invention to disclose an electrochemical cell as defined in any of the above, wherein said solution supply means are in fluid connection with a source of feed/electrolyte solution, said source of feed/electrolyte solution in fluid connection with a sour gas stream and comprising a column comprising a solvent and an absorbent for a sulfur-containing acid gas, disposed such that said sour gas stream contacts said absorbent thereby at least partially separating said sulfur-containing acid gas from said sour gas stream by reaction with said absorbent and forming said feed/electrolyte solution.

BRIEF DESCRIPTION OF THE DRAWINGS

The invention will be further explained in more detail with reference to drawings, wherein.

DETAILED DESCRIPTION OF PREFERRED EMBODIMENTS

Figure 1:
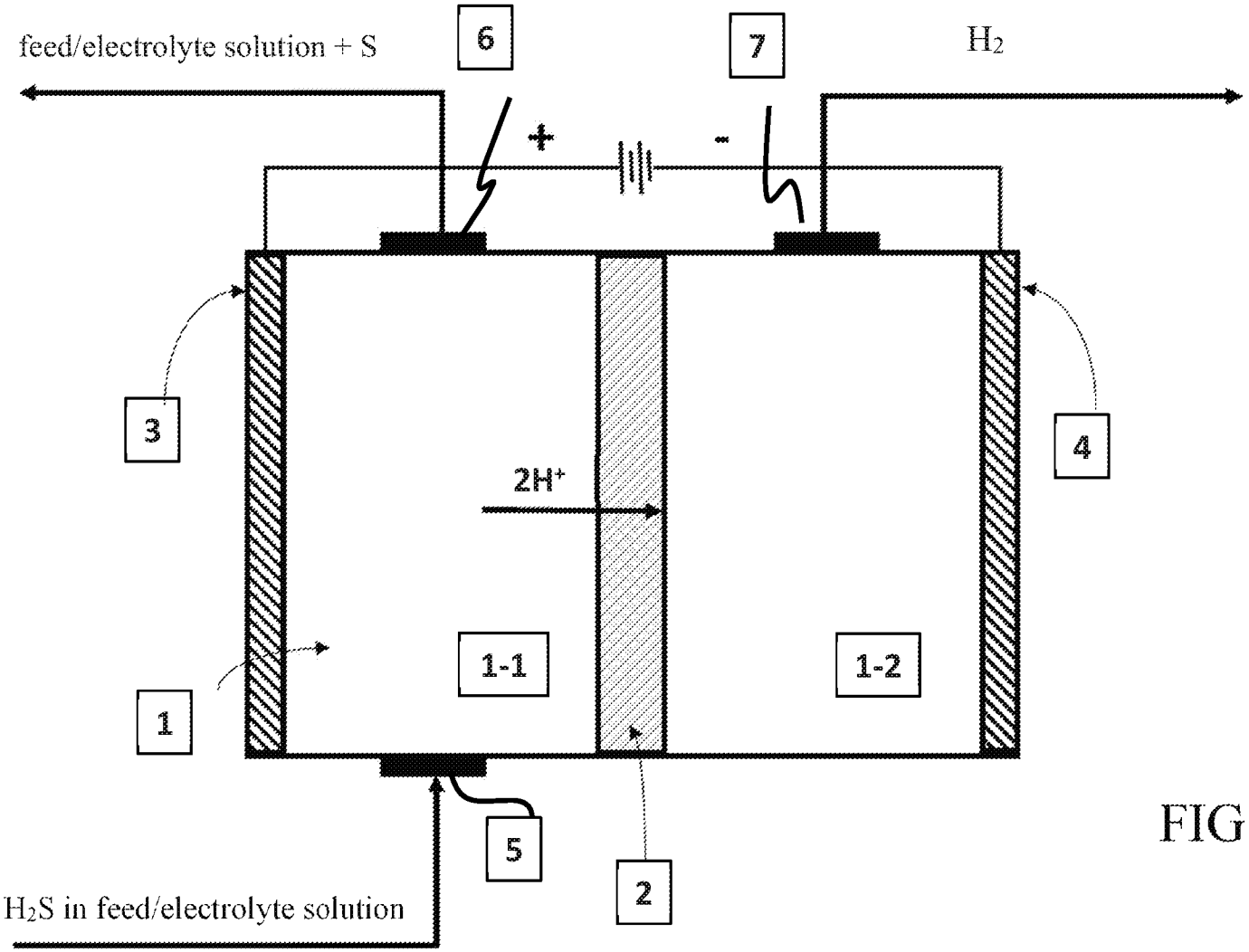
FIG. 1 shows a simplified schematic diagram of one embodiment of an apparatus for electrochemical production of hydrogen from the hydrogen sulfide supplied in solution with absorbent, comprising an electrochemical cell (electrolyzer) with a proton conductive membrane separating the electrodes; and, FIG. 2 shows a simplified schematic diagram of one embodiment of an apparatus for electrochemical production of hydrogen from water with presence of sulfur dioxide as an anode depolarizer, where the sulfur dioxide supplied in the solution with absorbent.

The following description of certain exemplary embodiments of the invention is given to explain the principles of the invention and its practical applicability in order that a person of ordinary skill will be able to make and use the invention. The embodiments disclosed in the following description are not intended to be limiting. The invention disclosed herein is thus not defined by the particular embodiments described in the specification, but by the claims, and only by the broadest interpretation of said claims. In addition, while in some cases, for clarity, individual components, method steps, or specific combinations thereof, are described, all combinations of components or method steps disclosed in the specification that are not self-contradictory are considered by the inventor to be within the scope of the invention.

With reference to electrical connections to an electrochemical cell, as used herein, the term "electrical connections from an external power supply" refers to any connection that places at least part of the electrochemical cell in electrical contact with a physical body or a circuit that is located partially or entirely outside of the electrochemical cell.

As used herein, with respect to an electrochemical cell, the term "positive electrode" refers to the anode and the term "negative electrode" refers to the cathode.

As used herein, with reference to electrochemical production of hydrogen from a solution containing hydrogen sulfide, the term "sulfur" is used to refer generically to any sulfur-containing species produced at the anode. Non-limiting examples of substances that fall within this definition include elemental sulfur as isolated sulfur atoms, elemental sulfur in any of its allotropic forms, and polysulfide anions.

As used herein, the term "sour gas" is used to refer to a gas that contains at least one acidic sulfur gas such as $H_2S$ or $SO_2$ as an impurity.

The invention disclosed herein provides a method and system for electrochemical production of hydrogen in the presence of a sulfur-containing acid as, and for electrochemical purification of a gas that comprises a sulfur-containing acid gas. In preferred embodiments of the invention, the sulfur-containing acid gas is $H_2S$ or $SO_2$.

In the case where the gas contains hydrogen sulfide, the reaction is carried out in an electrochemical cell (electrolyzer) where hydrogen sulfide is decomposed electrochemically to hydrogen gas and elemental sulfur. The regeneration of hydrogen sulfide rich absorbents in an electrochemical cell is likely to be more effective than traditional methods of regenerating absorbents in desorber columns by heating and reducing pressure.

In preferred embodiments, alkanolamines are used as absorbents for $H_2S$. These compounds tend to be more effective for the electrochemical decomposition of hydrogen sulfide than physical absorbents due to their use in the form of aqueous solutions.

Without being bound by theory, in solution, $H_2S$, which is acidic, reacts almost instantaneously with the basic amines by proton transfer. The amine accepts a hydrogen ion ($H^+$) from the $H_2S$, creating an $HS^-$ anion, eqs (22) and (23):

$$H_2S\ HS^- + H^+ \tag{22}$$

$$H_2S + \text{Amine} \Leftrightarrow [\text{Amine}]H^+ + HS^- \tag{23}$$

The reaction with the amine creates an anion from the acid gas, thereby removing it from the gas phase, while the amine is bound to the $H^+$ and does not readily release it. The ionization reaction is instantaneous but can be readily reversed just by a shift in pH. When the $H_2S$/amine feed/electrolyte solution is placed in an electrochemical cell which is then connected to an external power source, hydrogen gas will be generated at the cathode and elemental sulfur will be generated at the anode, eqs (24)-(26).

$$\text{At anode: } H_2S \rightarrow S + 2H^+ + 2\bar{e} \tag{24}$$

$$\text{At cathode: } 2H^+ + 2\bar{e} \rightarrow H_2 \tag{25}$$

$$\text{Overall reaction: } H_2S \rightarrow H_2 + S \tag{26}$$

Different designs of electrolyzers for the electrochemical decomposition of hydrogen sulfide are within the scope of the invention. Non-limiting examples include liquid electrolyte electrolyzers and Proton Exchange Membrane (PEM) electrolyzers that have been developed for water electrolysis applications. A membrane electrode assembly (MEA) of the PEM electrolyzer provides both the reaction interface and the ion migration route; in addition, it provides a good surface for electron dispersal away from the reaction interface. The PEM electrolyzer includes a membrane that will let hydrogen ions (protons) pass through but stop hydrogen gas from flowing through. The membrane is also intended to prevent other chemical species from migrating between electrodes and undergoing undesired reactions that could poison the cathode or reduce overall process efficiency.

It is within the scope of the invention to disclose an electrochemical cell configured to produce hydrogen from a gas containing an acidic sulfur-containing gas such as $H_2S$ or $SO_2$.

In the method disclosed herein, a feed/electrolyte solution comprising an acidic sulfur-containing gas and an absorbent is introduced into an electrochemical cell. The electrochemical cell is attached to an external energy source, thereby causing an electrochemical reaction to take place within the cell that generates hydrogen gas and oxidizes the sulfur in the sulfur-containing acid gas (e.g. to sulfur in the case of $H_2S$ and to $H_xSO_y^{n-}$ in the case of $SO_2$).

The feed/electrolyte solution may be prepared by any method known in the art. The feed/electrolyte solution may be prepared, for example, directly from a source of the sulfur-containing acid gas, the absorbent, and an appropriate solvent. In cases in which the sulfur-containing acid gas serves as an anode depolarizer in the electrochemical cell (e.g. when it is $SO_x$), then the solution will necessarily contain water, as in these cases the water is the source of the electrochemically produced hydrogen gas. In some embodiments of the invention, the sulfur-containing acid gas is obtained from sour gas. While any means known in the art can be used to separate the sulfur-containing acid gas from the sour gas, in preferred embodiments of the invention, a sour gas stream is passed through a column containing a solution of an absorbent under appropriate conditions of temperature and pressure. The sulfur-containing acid gas preferentially reacts with the absorbent and is thereby at least partially removed from the sour gas stream. A purified gas stream exits the column, and the remaining solution, comprising the sulfur-containing acid gas and the absorbent, is removed from the column and used as the feed/electrolyte solution. The method and system disclosed herein can thus be integrated into a system for removing sulfur-containing impurities from sour gas, e.g. in a sour gas or flue gas scrubber.

The electrochemical cell comprises at least two electrodes connected to an external power supply; in different electrochemical cell designs the electrodes can be separated by the feed/electrolyte solution or by a proton conductive separator such as a proton-conductive membrane. It is also necessary to ensure supply of the feed/electrolyte solution to the electrochemical cell and withdrawal of the regenerated solution and products of the electrochemical reaction from the cell.

In those embodiments in which the acidic sulfur-containing gas is $H_2S$, a feed/electrolyte solution comprising hydrogen sulfide and an absorbent such as an alkanolamine, a physical hydrogen sulfide absorbent, or a mixture thereof is introduced into the electrochemical cell.

Reference is now made to FIG. 1, which illustrates schematically one non-limiting embodiment of an electrochemical cell for production of hydrogen from hydrogen sulfide according to the present invention. The electrochemical cell depicted in the figure comprises a frame (1); a proton exchange membrane (PEM) (2); a positive electrode (anode) (3); and a negative electrode (cathode) (4). Each electrode typically consists of an electrically-conductive structure and when the cell is in use, both are connected to an external power supply. In the embodiment shown, one PEM membrane is used; in other embodiments, a plurality of membranes may be used, or the anode and cathode can be separated by the feed/electrolyte solution. The PEM membrane can be made from polymeric, ceramic or other specially elaborated and composite materials, such as Nafion, Polybenzimidazole, Sulfonated Polybenzimidazole (s-PBI), Sulfonated Diels-Alder Polyphenylene, Sulfonated PFCB-BPVE Tetramer, Silica, Hybrid Silica Nafion nanocomposites etc., which let hydrogen ions (protons) pass through membrane but stop hydrogen gas and other compounds. PEM 2 divides the interior of frame 1 into an anode chamber (1-1) and a cathode chamber (1-1). Anode chamber 1-1 includes an inlet (5) and an outlet (6), and cathode chamber 1-2 includes an outlet (7). In operating mode, inlet 5 is used to admit into anode chamber 1-1 a feed/electrolyte solution comprising hydrogen sulfide and absorbent, and outlet 6 is used to remove the absorbent solution and the sulfur (i.e. the product of the electrochemical reaction) from the anode chamber. Molecular hydrogen generated at the cathode exits the cathode chamber via outlet 7. Note that in embodiments of the invention in which the cathode an anode are separated by the feed/electrolyte solution, there will not be separate anode and cathode chambers, and inlet 5 and outlets 6 and 7 will all be connected to the single chamber of the cell.

In some embodiments of the invention in which the electrochemical cell comprises a proton-conductive separator, the separator (e.g. a PEM) comprises at least one catalyst layer that incorporates a catalyst. Such membranes and catalysts are well-known in the art, for example, in the SDE process described above. These catalysts can influence the cell voltage for the electrolysis, thereby enhancing the efficiency of the process, and can also favorably affect the stable operation of the cell. The separator may include more than one catalyst layer, and the anode and cathode sides of the separator may incorporate different catalysts. In some non-limiting preferred embodiments, the separator comprises an anode-side catalyst selected from the group consisting of platinum, ruthenium, palladium, and mixtures, alloys, and combinations thereof. In some non-limiting preferred embodiments, the separator comprises a cathode-side catalyst selected from the group consisting of platinum, ruthenium, palladium, iridium, aluminum, lead, metal oxides, and mixtures, combinations, and alloys thereof. In some preferred embodiments of the invention, the metal oxide is selected from the group consisting of oxides of palladium, ruthenium iridium, aluminum, and lead, $SnO_2$, $SbO_2$, $TaO_2$, $TiO_2$, and $Ti_4O_7$.

In some embodiments of the invention, it comprises means for circulating feed/electrolyte solution through the cell. Any means known in the art (e.g. a pump with a speed and capacity appropriate for the cell) may be used. In some embodiments of the invention, the circulation means provide a fluid connection between inlet 5 and outlet 6 so that the feed/electrolyte solution is recirculated through the cell. In some embodiments of the invention, it comprises a water supply inlet to the cathode chamber. The water serves for hydration of the PEM in cases in which a physical hydrogen sulfide absorbent is used. The hydrated regions in some types of polymer electrolyte membranes create better conductivity of $H^+$ ions. In some embodiments, the water is used for cooling or temperature control. For simplicity and clarity, certain standard elements of PEM electrochemical cell are not shown or described herein (for example anode and cathode collectors, diffusion layers and catalysts which are used in order to increase the cell's capacity).

Absorbents, which are supplied to the electrochemical cell according to the invention, are preferably based on alkanolamines, non-limiting examples of which include monoethanolamine, diethanolamine, triethanolamine, methyldiethanolamine, diisopropanolamine, diglycolamine and mixtures thereof, and physical hydrogen sulfide solvents, such as N-methylpyrrolidone, dimethyl ether of polyethylene glycol, tributyl phosphate, methanol or mixtures thereof, as well as any mixtures of at least one alkanolamine-based absorbent with at least one physical hydrogen sulfide solvent at any ratio thereof. The alkanolamine containing absorbents are supplied in solution with water. The concentration of the solution of alkanolamine based absorbents and/or physical hydrogen sulfide solvents supplied to the electrochemical cell is preferably from 10 to 100% by weight, depending on the absorbent type.

If necessary, the electrochemical cell may further comprise means for removing the product of the reaction occurring in the electrochemical cell, in particular, means for removing sulfur-containing species such as elemental sulfur and polysulfide ions produced within the cell.

In some embodiments, the electrochemical cell herein disclosed is configured to produce hydrogen from water in the presence of sulfur dioxide as an anode depolarizer and an aqueous feed/electrolyte solution comprising a sulfur dioxide absorbent. Non-limiting examples of sulfur dioxide absorbents include amines, other chemical or physical sulfur dioxide organic absorbents, and mixtures thereof. When in use, the electrochemical cell comprises at least two electrodes connected to an external power supply; in different electrochemical cell designs the electrodes can be separated by the feed/electrolyte solution per se or at least one proton conductive membrane. It is also necessary to ensure supply of the feed/electrolyte solution to the electrochemical cell and withdrawal of the regenerated solution and products of the electrochemical reaction from the cell.

Without wishing to be bound by theory, in some embodiments of the invention, the following reactions are believed to occur in the electrochemical cell (electrolyzer) with the sulfur dioxide rich chemical absorbents and/or physical sulfur dioxide absorbents:

$$\text{At anode: } SO_{2\,(aq)}+2H_2O \rightarrow 4H^+ + 2\bar{e} + SO_4^{2-}{}_{(aq)} \quad (27)$$

$$\text{At cathode: } 2H^+ + 2\bar{e} \rightarrow H_{2(g)} \quad (28)$$

$$\text{Overall reaction: } SO_{2\,(aq)}+2H_2O \rightarrow 2H^+ + SO_4^{2-}{}_{(aq)} + H_{2(g)} \quad (29)$$

In eqs (27) and (29), the product of oxidation of $SO_2$ is written as $SO_4^{2-}$, but depending on specific conditions, other products of the general formula $H_xSO_y^{n-}$, $0 \le x \le 2$, y=3 or 4, $0 \le n \le 2$, may be formed in addition to or instead of sulfate anion.

The absorbents increase the solubility of the sulfur dioxide in the aqueous solution, thus the oxidation of $SO_2$ occurs at a much lower voltage than water electrolysis. Due to the "chemical solubility", the electrochemical oxidation of $SO_2$ dissolved, for example, in amine-based absorbents is expected to occur at a lower voltage than in the SDE electrolyzer discussed above.

Figure 2:
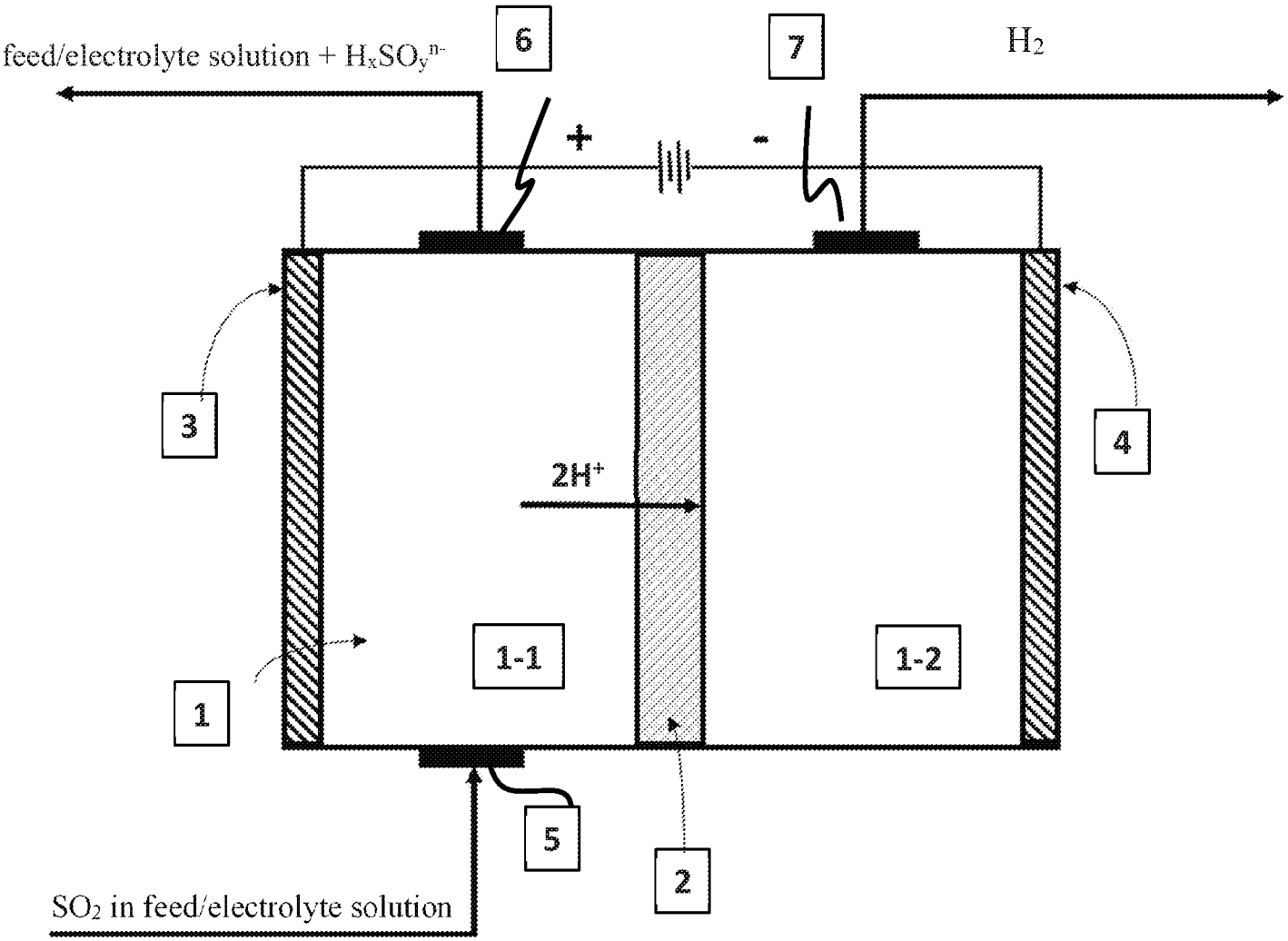

Reference is now made to FIG. 2, which illustrates a second non-limiting embodiment of an electrochemical cell for production of hydrogen in the presence of $SO_2$ according to the present invention. In this embodiment, the electrochemical cell comprises a frame (1); a proton exchange membrane (PEM) (2); a positive electrode (anode) (3) and a negative electrode (cathode) (4). Each of the anode 3 and the cathode 4 typically consists of an electrically-conductive structure and when the cell is in use, both are connected to an external power supply. In the embodiment shown, one PEM membrane is used; in other embodiments, a plurality of membranes may be used, or the anode and cathode can be separated by the feed/electrolyte solution. The PEM membrane can be made from polymeric, ceramic or other specially elaborated and composite materials, such as Nafion, Polybenzimidazole, Sulfornated Polybenzimidazole (s-PBI), Sulfonated Diels-Alder Polyphenylene, Sulfonated PFCB-BPVE-Tetramer, Silica, Hybrid Silica Nafion nanocomposites etc., which let hydrogen ions (protons) pass through membrane but stop hydrogen gas and other compounds. PEM 2 divides the interior of frame 1 into an anode chamber (1-1) and a cathode chamber (1-2). Anode chamber 1-1 includes an inlet (5) and an outlet (6), and cathode chamber 1-2 includes an outlet (7). In operating mode, inlet 5 is used to admit into anode chamber 1-1 the water and the sulfur dioxide supplied in the solution with absorbent, and the outlet 6 is used to remove from the anode chamber 1-1 the feed/electrolyte solution with products of the reaction (sulfate anions or sulfuric acid). Hydrogen gas generated at the cathode exits the cathode chamber via outlet 7. Note that in embodiments of the invention in which the cathode an anode are separated by the feed/electrolyte solution, there will not be separate anode and cathode chambers.

In some embodiments, the electrochemical cell comprises an inlet to cathode chamber 1-2 for water supply, in order to enhance hydrogen gas removal and for safety. In some embodiments, the water is used as needed for cooling or temperature control. For simplicity and clarity, certain standard elements of PEM electrochemical cell are not shown or described herein (for example anode and cathode collectors, diffusion layers and catalysts which are used in order to increase cell's capacity).

Analogously to the electrochemical cell described above for production of hydrogen gas from $H_2S$, the proton-conductive separator may contain one or more catalyst layers. In some non-limiting preferred embodiments, the separator comprises an anode-side catalyst selected from the group consisting of platinum, ruthenium, palladium, and mixtures, alloys, and combinations thereof. In some non-limiting preferred embodiments, the separator comprises a cathode-side catalyst selected from the group consisting of platinum, ruthenium, palladium, iridium, aluminum, lead, metal oxides, and mixtures, combinations, and alloys thereof. In some preferred embodiments of the invention, the metal oxide is selected from the group consisting of oxides of palladium, ruthenium iridium, aluminum, and lead, $SnO_2$, $SbO_2$, $TaO_2$, $TiO_2$, and $Ti_4O_7$.

If necessary, the electrochemical cell may further comprise means for removing the product of the reaction occurring in the electrochemical cell, which are not removed by withdrawing the feed/electrolyte solution, or which occurs in the cathode chamber (in case of undesirable $SO_2$ crossover through the PEM), in particular, sulfur compounds.

The sulfur dioxide absorbent supplied to the electrochemical cell according to the invention is preferably either the amine-based and/or other chemical or physical sulfur dioxide organic absorbent, or a mixture thereof, as described above. In this process, the amount of the organic absorbents in the sulfur dioxide absorbent solution can be from 10 to 100 percent by weight depending on the absorbent type. Solutions including any mixtures containing a combination of any of the amines and any other chemical and physical sulfur dioxide organic solvents may also be employed.

In some embodiments of the invention, the method is performed on a system comprising a plurality (stack) of electrochemical cells connected in series. The use of a plurality of cells will enhance the overall electrolysis capability relative to the use of a single cell.

In some embodiments of the invention in which a stack of electrochemical cells is used, the feed/electrolyte solution is circulated through the system. In one non-limiting of the invention, inlet 5 of the first cell in the stack is connected to a source of feed/electrolyte system, and for each succeeding cell in the stack until the last one, outlet 6 of the cell is connected to inlet 5 of a following cell (e.g. the next cell) in the stack. The feed/electrolyte solution may be discarded from the final cell in the stack, or outlet 6 of the final cell can be connected to inlet 5 of the first cell, thereby allowing circulation of feed/electrolyte solution through the stack. If the outlet of the final cell is connected to the inlet cell, then the connection from the source of feed/electrolyte solution to the first cell can be closed after the cells in the stack are full. In embodiments that comprise a stack of electrochemical cells, any connection of the cells to a source and drain of feed/electrolyte solution, whether it permits circulation to and from any or all of them, is considered by the inventor to be within the scope of the invention.

In some embodiments of the invention, the absorbent is regenerated and optionally reused. In some non-limiting embodiments, the absorbent is regenerated by removing the feed/electrolyte solution from the cell and separating the absorbent therefrom. Any means for regenerating the absorbent known in the art may be used.

It shall be understood that the above description is merely illustrative, and the claims cover all modifications or alternatives that could be obvious to a person skilled in the art.

What is claimed is:

1. A method for production of hydrogen gas in the presence of a sulfur-containing acid gas, said method comprising:

providing at least one electrochemical cell, said electrochemical cell comprising:

at least one positive electrode (anode) and one negative electrode (cathode);

solution supply and withdrawal means for supplying and withdrawing a feed/electrolyte solution to and from said electrochemical cell; product withdrawal means for withdrawing from said electrochemical cell products of electrochemical reactions occurring within said electrochemical cell; and, electrical connecting means configured to provide external electrical connections to at least one of said positive electrode and said negative electrode;

supplying to said electrochemical cell a feed/electrolyte solution comprising a sulfur-containing acid gas and at least one absorbent for said sulfur-containing acid gas;

connecting said electrochemical cell to an external power supply so as to cause within said electrochemical cell an electrochemical reaction that produces hydrogen gas; and, removing said electrochemically produced hydrogen gas from said electrochemical cell;

wherein:

said feed/electrolyte solution is selected from the group consisting of:

feed/electrolyte solutions comprising hydrogen sulfide and a hydrogen sulfide absorbent comprising an alkanolamine;

feed/electrolyte solutions comprising hydrogen sulfide and a physical hydrogen sulfide absorbent selected from the group consisting of N-methylpyrrolidone, dimethyl ether of polyethylene glycol, tributyl phosphate, and methanol; and, feed/electrolyte solutions comprising sulfur dioxide, water, and a sulfur dioxide absorbent selected from the group consisting of primary amines, secondary amines, tertiary amines, triamines, and tetraamines.

2. The method according to claim 1, wherein said step of supplying a feed/electrolyte solution comprising a sulfur-containing acid gas and at least one absorbent for said sulfur-containing gas comprises supplying a feed/electrolyte solution comprising at least 10% by weight of said absorbent.

3. The method according to claim 1, wherein:

said electrochemical cell comprises a proton-conductive separator that divides said cell into an anode compartment in electrical connection with said anode and a cathode compartment in electrical connection with said cathode; and, said solution supply and withdrawal means are in fluid connection with said anode compartment but are not in fluid connection with said cathode compartment.

4. The method according to claim 3, wherein said proton-conductive separator comprises at least one component selected from the group consisting of proton-conductive membranes and catalyst layers.

5. The method according to claim 4, wherein:

said proton-conductive separator comprises a catalyst layer, said catalyst layer comprising an anode side and a cathode side;

said anode side comprises a catalyst selected from the group consisting of platinum, ruthenium, palladium, and mixtures thereof; and, said cathode side comprises a catalyst selected from the group consisting of platinum, ruthenium, palladium, iridium, aluminum, lead, metal oxides, mixtures thereof, alloys thereof, and combinations thereof.

6. The method according to claim 1, wherein said feed/electrolyte solution comprises hydrogen sulfide and a hydrogen sulfide absorbent and said method comprises removing from said electrochemical cell sulfur produced in said electrochemical reaction.

7. The method according to claim 1, wherein:

said feed/electrolyte solution comprises hydrogen sulfide and an absorbent comprising an alkanolamine; and, said alkanolamine is selected from the group consisting of monoethanolamine, diethanolamine, triethanolamine, methyldiethanolamine, diisopropanolamine, diglycolamine, and mixtures thereof.

8. The method according to claim 1, wherein said feed/electrolyte solution comprises sulfur dioxide, water, and a sulfur dioxide absorbent and, said method comprises removing from said electrochemical cell said feed/electrolyte solution containing products of said electrochemical reaction.

9. The method according to claim 4, wherein said proton-conductive separator comprises at least one of:

an anode side catalyst layer comprising a catalyst selected from the group consisting of platinum, ruthenium, palladium, and mixtures thereof; and, a cathode side catalyst layer comprising a catalyst selected from the group consisting of platinum, ruthenium, palladium, iridium, aluminum, lead, metal oxides, mixtures thereof, alloys thereof, and combinations thereof.

10. The method according to claim 1, wherein:

said feed/electrolyte solution comprises sulfur dioxide and a sulfur dioxide absorbent, and, said sulfur dioxide absorbent is selected from the group consisting of: at least one amine compound selected from the group consisting of Monoethanolamine (MEA), Diethanolamine (DEA), Trimethylamine (TMA), Triethylamine (TEA), Triethanolamine (TEOA), Methyldiethanolamine (MDEA), Dimethylamine (DMA), Diisopropanolamine (DIPA), Diglycolamine (DGA), Tripropanolamine, Tributanolamine, Tetrahydroxy-methylenediamine, Tetrahydroxyethyl-ethylenediamine, Tetrahydroxyethyl-I, 3-propylenediamine, Tetrahydroxyethyl-1, 2 propylenediamine, Tetrahydroxyethyl-1, 5 -pentylenediamine, Dihydroxyethyl-ethylenediamine, Monohydroxymethyl-diethylenetriamine, Monomethyl-monohydroxylethyl-triethylenetetramine, Diethylenetriamine, Triethylenetetramine, Tetraethylenepentamine, N,N,N',N'-Tetrakis-(2-hydroxyethyl)-I, 3-diaminopropane, N,N,N',N'-Tetrakis-(2-hydroxyethyl)-ethylenediamine, N,N,N',N'-Tetrakis (Z-hydroxyethyl)-ethylenediamine, N,N,N',N'-Tetramethyl-ethylenediamine, N,N,N',N'-Tetramethyl-diaminomethane, N,N',N'-Trimethyl-N-(2-hydroxyethyl)-ethylenediamine, N',N'-Dimethyl-N,N-bis(2-hydroxyethyl)-ethylenediamine, N,N'-Dimethylpiperazine, N,N'-Bis(2-hydroxyethyl)-piperazine, N-Methyl, N'-(2-hydroxyethyl)-piperazine, N-(2-hydroxyethyl)-ethylenediamine, N-(2-hydroxyethyl)-piperazine, N-Methyl-piperazine, and mixtures thereof and, at least one physical sulfur dioxide absorbent selected from the group consisting of Dimethyl ether (DME), Polyethylene glycol, Tributyl phosphate, Methanol, Dimethyl Ether of Polyethylene Glycol (DEPG), Diethylene Glycol Methyl Ether (DGM), Sulfolane (SUF), Ethylene glycol (EG), Propylene carbonate (PC), N-methylimidazole (NMI), N-Methyl-Pyrrolidone (NMP), and mixtures thereof.

11. The method according to claim 1, wherein said feed/electrolyte solution comprises sulfur dioxide, a sulfur dioxide absorbent, and at least one organic solvent selected from the group consisting of pyridine and piperazine.

12. The method according to claim 1, wherein said step of supplying to said electrochemical cell a feed/electrolyte solution comprising a sulfur-containing acid gas and at least one absorbent for said sulfur-containing acid gas comprises supplying a feed/electrolyte solution comprising a sulfur-containing acid gas obtained from sour gas.

13. The method according to claim 1, wherein said step of providing at least one electrochemical cell comprises providing a plurality of electrochemical cells connected in series.

14. An electrochemical cell (electrolyzer) for production of hydrogen in the presence of a sulfur-containing acid gas, comprising:

at least one positive electrode (anode) and one negative electrode (cathode);

a feed/electrolyte solution comprising said sulfur-containing acid gas;

solution supply and withdrawal means for supplying and withdrawing said feed/electrolyte solution to and from said electrochemical cell;

optionally, circulating means configured to circulate feed/electrolyte solution through said electrochemical cell;

product withdrawal means for withdrawing from said electrochemical cell products of electrochemical reactions occurring within said electrochemical cell; and, electrical connecting means configured to provide external electrical connections to at least one of said positive electrode and said negative electrode;

wherein:

said feed/electrolyte solution is selected from the group consisting of:

feed/electrolyte solutions comprising hydrogen sulfide and an absorbent comprising an alkanolamine;

feed/electrolyte solutions comprising hydrogen sulfide and a physical hydrogen sulfide absorbent selected from the group consisting of N-methylpyrrolidone, dimethyl ether of polyethylene glycol, tributyl phosphate, and methanol; and, feed/electrolyte solutions comprising sulfur dioxide, water, and a sulfur dioxide absorbent selected from the group consisting of primary amines, secondary amines, tertiary amines, triamines, and tetraamines.

15. The electrochemical cell according to claim 14, wherein:

said electrochemical cell comprises a proton-conductive separator that divides said cell into an anode compartment in electrical connection with said anode and a cathode compartment in electrical connection with said cathode; and, said solution supply and withdrawal means are in fluid connection with said anode.

16. The electrochemical cell according to claim 15, wherein said proton-conductive separator comprises at least one component selected from the group consisting of proton-conductive membranes and catalyst layers.

17. The electrochemical cell according to claim 16, wherein:

said proton-conductive separator comprises a catalyst layer comprising an anode side and a cathode side;

said anode side comprises a catalyst selected from the group consisting of platinum, ruthenium, palladium, and mixtures thereof; and, said cathode side comprises a catalyst selected from the group consisting of platinum, ruthenium, palladium, iridium, aluminum, lead, metal oxides, mixtures thereof, alloys thereof, and combinations thereof.

18. The electrochemical cell according to claim 14, wherein:

said feed/electrolyte solution comprises hydrogen sulfide and an absorbent comprising an alkanolamine; and, said product withdrawal means comprise means for withdrawing sulfur from said electrochemical cell.

19. The electrochemical cell according to claim 14, wherein:

said feed/electrolyte solution comprises sulfur dioxide, water, and a sulfur dioxide absorbent selected from the group consisting of primary amines, secondary amines, tertiary amines, triamines, and tetraamines; and, said product withdrawal means comprise means for withdrawing said feed/electrolyte solution containing products of said electrochemical reaction.

20. The electrochemical cell according to claim 14, wherein at least one of solution supply and withdrawal means and said product withdrawal means is in fluid connection with regenerating means for regenerating said absorbent from products of said electrochemical reactions.

* * * * *